US005649668A

United States Patent [19]

Steinberg

[11] Patent Number: 5,649,668

[45] Date of Patent: Jul. 22, 1997

[54] CHOPPER ARRANGEMENT

[76] Inventor: Morris Steinberg, 8859 Burton Way, Los Angeles, Calif. 90048

[21] Appl. No.: 162,439

[22] Filed: Dec. 3, 1993

[51] Int. Cl.[6] ..... B02C 18/18

[52] U.S. Cl. ..... 241/192; 241/294; 241/300.1

[58] Field of Search ..... 241/192, 242, 241/294, 300.1

[56] References Cited

U.S. PATENT DOCUMENTS

| | | | |
|---|---|---|---|
| 3,378,053 | 4/1968 | Potzsch | 241/192 |
| 3,946,474 | 3/1976 | Hahn et al. | 241/294 |
| 4,009,837 | 3/1977 | Schnyder | 241/93 |
| 5,060,875 | 10/1991 | McBride | 241/242 |
| 5,240,192 | 8/1993 | Tilby et al. | 241/292.1 |
| 5,297,746 | 3/1994 | McBride et al. | 241/242 |
| 5,320,292 | 6/1994 | Smith | 241/191 |

FOREIGN PATENT DOCUMENTS

| | | | |
|---|---|---|---|
| 2630664 | 11/1989 | France | 241/294 |

*Primary Examiner*—John Husar

[57] ABSTRACT

An improved chopper arrangement for use in recovering and allowing the recycling of chopped metal products such as steel, aluminum, copper as utilized in electric transmission lines as well as the recovery of insulation materials thereon. The chopper contains a rotor mounted for rotation within a housing. The rotor has a plurality of rotor cutting blades thereon which pass in wire chopping relationship to at least one fixed blade mounted on a cartridge coupled to the housing. The fixed blade or cartridge cutting blade and the rotating blades or rotor cutting blade are generally rectangular in cross-section. Each of the rotor cutting blades is clampingly mounted on the rotor to allow comparatively rapid movement of the rotor cutting blade towards and away from the cartridge cutting blade to accommodate for wear of the blades and/or differences in the material being chopped. Similarly, the cartridge cutting blade may be clampingly mounted on the cartridge for movement towards and away from the rotor to accommodate for various materials being chopped and wear on the cutting blade. The entire cartridge itself is movably mounted on the housing and may be conveniently moved towards and away from the rotor for additional adjustments as may be required.

49 Claims, 10 Drawing Sheets

CHOPPER ARRANGEMENT

BACKGROUND OF THE INVENTION

1. Field of the Invention

This invention relates to the metal chopping art and, more particularly, to an improved chopper arrangement particularly adapted for chopping insulated transmission lines such as power lines, communication cables, telephone lines, or other metallic-insulated wire or uninsulated wire so as to recover and allow recycling of the metal and of the insulation thereon.

2. Description of the Prior Art

Chopper arrangements of various types have heretofore been utilized for severing material into comparatively short-length segments. However, for many types of materials, such prior art chopper arrangements have not been completely satisfactory. For example, in cutting heterogeneous materials such as transmission lines which may include steel strands which are utilized for strength in the center of the transmission lines and aluminum strands on the exterior thereof for the electrical carrying capacity and such transmission lines covered with insulation, as well as insulated copper electrical transmission lines, prior art chopping arrangements have not always been able to provide a separation of the insulation from the metallic portion of such wire transmission lines and/or have required extensive time for making adjustments to the cutting blades as such blades wear during the cutting operation and/or as different types of material may be fed into the chopper for appropriate cutting.

It is, of course, desirable to recycle as much of the transmission line as possible so that, for example, new aluminum, steel, of copper products may be made from the chopped metal portions of the line and even those portions of the insulation which are reusable, such as certain plastic insulations, may also be salvaged for subsequent use. It is obvious, of course, that the transmission lines that may often be thousands of feet in length and which have been replaced by, for example, higher energy capacity carrying lines cannot be recycled directly in such lengths but first must be severed in to comparative small length segments and, additionally, separated as to material.

For cutting insulated transmission lines into the desired small segments, it is preferred that an exceptionally high impact force be imparted to the transmission line during the chopping action and such high force may be achieved by, for example, a comparatively massive rotor supporting the rotor cutting blades. Such a rotor may, for example, be on the order of 5–7 tons. While the exact mechanism involved is not known, it is believed that the shock and acceleration forces imparted by such a massive rotor in striking the transmission lines to be severed tends to shatter the insulation and imparts a differential acceleration force to the metal parts and to the insulation such that the insulation falls away in small segments from the small segments of the metal portions of the transmission lines. Therefore, chopping can be accomplished in a single pass and not require that severed portions be transmitted to a second, third, etc. stage of chopping as is often required in prior art chopping arrangements.

Additionally, prior art choppers utilized for such purpose as above described have often required extensive down time to adjust the proper positioning of both the rotating cutting blades and the fixed cutting blades. It is recognized, of course, that blades in such a chopper arrangement will wear and require repositioning in order that they may be appropriate material cutting relationship to each other as required for different types of materials being chopped. Because of the comparatively long down time necessitated by prior blade mounting arrangements, the efficiency and chopping capacity per unit time of such prior art choppers has increased the cost per unit weight of the chopped materials.

SUMMARY OF THE INVENTION

Accordingly, it is an object of the present invention to provide an improved chopper arrangement.

It is another object of the present invention to provide an improved chopper arrangement having a comparatively massive rotor for imparting higher acceleration forces to the material being chopped during the chopping operation.

It is yet another object of the present invention to provide an improved chopping arrangement in which the rotating cutting blade means and/or the fixed cutting blade means may be rapidly moved towards and away from each other as required by blade wear and/or type of material being cut.

It is another object of the present invention to provide an improved chopper arrangement in which both the rotating cutting blades and the fixed cutting blades may be substantially identical in configuration and the mounting of the rotating blades and the fixed blades may be substantially identical in order to minimize the number of parts required and provide more complete interchangability of parts.

Various prior art chopping arrangements are shown, for example, in U.S. Pat. Nos. 3,776,079, 3,612,412, 3224,312, 2,497,155, 3,091,988, 3,648,556, 1,363,778, 1,908,014, 3,082,655, and 2,826,251. The present invention provides an improvement over the structural arrangements of each of the above patents.

In accordance with the principles of the present invention, the improved chopper arrangement is generally comprised, in a preferred embodiment, of a housing means having walls which define an internal cavity. A rotor means is rotatably mounted on the housing means for rotation in a preselected direction about a rotor axis within the cavity. The rotor means has a outer peripheral edge and a plurality of lobes are cut on the outer peripheral edge of the rotor means. The rotor is preferably fabricated from a hardened steel such as 4140 and is comparatively massive in weight. The axial length of the lobes may be, in preferred embodiments of the present invention, on the order of four-feet long and the overall length of the rotor may be on the order of nine feet. The diameter of the rotor to the outer peripheral edge of the lobes may be on the order of three feet to provide a total rotating mass of the rotor on the order of 12,000–14,000 pounds. It will be appreciated, of course, that other dimensions and weights may be selected for a particular application.

Each of the lobes on the rotor has a blade face which extends inwardly from the peripheral edge of the rotor and a rotor cutting blade is mounted on the blade face of each of the lobes. In the preferred embodiment of the present invention described herein, five separate lobes are provide on the rotor and, consequently, five separate rotor cutting blades are located on the rotor. Each of the lobes has a rotor blade locating means for the inwardly-outwardly positioning of the rotor. The rotor blade locating means on the lobes may, in a preferred embodiment of the present invention, comprise a plurality, such as three, spaced-apart locating buttons positioned in cavities formed in the blade face of each lobe of the rotor. The outer surface of the locating buttons is serrated and the serrations in the locating buttons are aligned substantially parallel to the rotor axis.

The rotor cutting blade is generally rectangular in cross-section and on the first surface of the rotor cutting blade, which is adjacent the blade face of the lobes on the rotor, there are provided three spaced-apart indexing means which may each comprise a plurality of serrations matching the pitch of the serrations in the locating button for interengagement therewith. Thus, the locating buttons on the blade face of the lobes may project above the plane of the blade face a sufficient distance to allow the serrations therein to interengage with the serrations in the rotor cutting blade.

The pitch of the serrations in the rotor blade indexing means and the locating buttons allows very precise reciprocal movement of the rotor cutting blade inwardly and outwardly towards and away from the peripheral edge in increments determined by the pitch of the serrations for precise positioning of the blades. The rotor cutting blade extends axially substantially the same axial extent of the lobes and the outer edge thereof is positioned outwardly a predetermined distance from the outer peripheral edge of the rotor to provide clearance for the chopping operation.

Rotor cutting blade hold-down bar means are provided at each of the lobes of the rotor and extend axially the length of the lobe and the rotor cutting blade. The rotor cutting blade hold-down bar means has an outer end portion which engages the second surface of the rotor cutting blade and the second surface is spaced from the first surface which engages the blade face of the lobes and also has an inner end portion for engaging a shoulder at the inner end of the lobe. Rotor cutting blade retention means which may comprise a plurality of bolts or screws in an axially spaced-apart array extend through the rotor cutting blade hold-down bar means and threadingly engage the lobes of the rotor. Tightening the bolts clamps the rotor cutting blade between the cutting face of the lobe and the rotor cutting blade hold-down bar means. The bolts are preferably free of engagement with the rotor cutting blade. Consequently, the rotor cutting blade may be conveniently, precisely, and easily moved in reciprocating directions towards and away from the outer peripheral edge of the rotor by loosening the bolts and moving the rotor blade in increments of the pitch of the serrations in the rotor cutting blade indexing means and locating buttons. The bolts may then be retightened to reclamp the cutting blade in the desired position. The rotor cutting blades, in preferred embodiments of the present invention, are free of any bolt holes or other apertures utilized, for example, in holding or mounting the blades.

The rotor cutting blades may, therefore, be considered the rotating blades of the present invention.

Fixed blades are also provided according to the principles of the present invention and the rotating blades mounted on the rotor are rotated in material chopping relationship to the fixed blades.

According to the principles of the present invention, a cartridge means is movably mounted on the housing and has a cartridge body movable for limited reciprocating motion towards and away from the rotor means in the cavity defined by the housing and the cartridge body has an inner surface positionable in preselected spaced relationship to the rotor. The cartridge body has a cartridge cutting blade mounting face extending inwardly from regions adjacent the walls of the housing into the cavity in the housing means and a cartridge cutting blade locating means is provided on the cartridge cutting blade mounting face. The cartridge cutting blade locating means may be substantially identical to the rotor cutting blade locating means and, thus, comprise a plurality of spaced apart locating buttons positioned in cavities in the cartridge cutting blade mounting face of the cartridge body and the outer surface of the locating buttons are provided with axially extending serrations.

A cartridge cutting blade means is mounted on the cartridge cutting blade mounting face of the cartridge body and the cartridge cutting blade may, for example, be identical to the rotor cutting blade to allow interchangeability of the parts. Therefore, the cartridge cutting blade has cartridge cutting blade indexing means which may comprise a plurality of serrations in spaced-apart locations for engagement with the serrations in the cartridge cutting blade locating means on the cartridge cutting blade mounting face of the cartridge body. A cartridge cutting blade hold-down bar means which may be identical to the rotor cutting blade hold-down bar means is provided for clamping the cartridge cutting blade to the cartridge body. Cartridge cutting blade retention means which may comprise bolts or screws substantially identical to the bolts or screws provided for clamping the rotor blade hold-down bar means to the rotor cutting blade. Therefore, the cartridge cutting blade may be selectively moved towards and away from the rotor cutting blade by loosening the screws or bolts comprising the cartridge cutting blade retention means and selectively moving the cartridge cutting blade in increments defined by the pitch of the serrations in the cartridge cutting blade locating means and cartridge cutting blade indexing means.

Additionally, in preferred embodiments of the present invention, the entire cartridge may be selectively moved by a cartridge adjustment means in reciprocating directions towards and away from the rotor. Such selective movement of the entire cartridge may be achieved by providing a plurality of axially spaced set screws extending through the cartridge and bearing against the walls of the housing. By loosening the main supporting screws or bolts which retain the cartridge on the housing and adjusting the set screws selective reciprocating movement of the entire cartridge, including the cartridge rotating blade, may be achieved. Since such set screws and the mounting bolts for the cartridge are on the exterior of the housing, the selective reciprocating movement of the entire cartridge may be achieved without entering into the cavity of the housing.

The rotor, as noted above, is provided with a plurality of rotor cutting blades mounted thereon, for example, five blades. As a result, for each rotation of the rotor, each fixed or cartridge cutting blade is subjected to five chopping impacts per revolution. The cartridge cutting blades will, therefore, tend to wear five times as fast as each rotor cutting blade. The provision of the cartridge adjustment means allows for rapid and convenient adjustment of the cartridge cutting blade in relationship to the rotor cutting blade in order to maintain the desired chopping spacing therebetween.

When a cutting edge on the cartridge cutting blade is sufficiently worn or there is no longer any cartridge adjustment to be utilized, the cavity of the housing may be entered and the cartridge cutting blade hold-down bar loosened to allow further adjustment or removal and rotation of the cartridge cutting blade.

In preferred embodiments of the present invention, the axially extending first and second surfaces of both the rotor cutting blade and cartridge cutting blade are provided with the indexing means comprising the plurality of serrations. Since the cutting blades are rectangular in section, as cutting edges are worn, the entire cutting blade may, for example, be rotated so that, ultimately, all four edges may be utilized as the cutting edge before any machining or regrinding need be done to sharpen such edges.

Material to be chopped such as, for example, insulated electrical transmission line which may be homogenous or heterogeneous as to the metal contained therein is fed into the cavity defined of the housing at the top portion thereof through a protective hood. The rotating rotor brings the material to be chopped into chopping relationship to the cartridge cutting blade and the interaction of the rotor cutting blade therewith severs the transmission line. The high mass of the rotor, it is believed, causes a shock to the portion of the transmission line that is severed tending to split the insulation and impart acceleration forces to the chopped portion such that the heavier metal portion of the transmission line accelerates away from the insulation. The chopped portions are removed from the housing for further differential separating as may be required. The chopped material is removed from the housing cavity in regions at the bottom thereof.

If desired, coolant passages may be provided in the cartridge body to provide cooling thereof during operation.

A drive means which, for example, may be an electric motor, is coupled to the rotor to rotate the rotor in the desired direction. The electric motor in the preferred embodiments of the present invention, may be a 750 volt DC, 500 horsepower traction motor appropriately coupled by conventional means to the rotor shaft.

In the preferred embodiment of the present invention described herein, a second cartridge means which may be substantially identical to the first cartridge means is mounted on the housing on the opposite side of a vertical plane extending through the rotor axis from the first cartridge means. The second cartridge means provides additional chopping action as each of the rotor blades passes in material chopping relationship thereto and also supports both a screen and back up plate to prevent the chopped material progressing to regions other than the cavity of the housing from which it may be removed.

BRIEF DESCRIPTION OF THE DRAWINGS

The above and other embodiments of the present invention may be more fully understood from the following detailed description taken together with the accompanying drawings wherein similar reference characters refer to similar elements throughout and in which.

DESCRIPTION OF THE PREFERRED EMBODIMENTS

Figure 1:
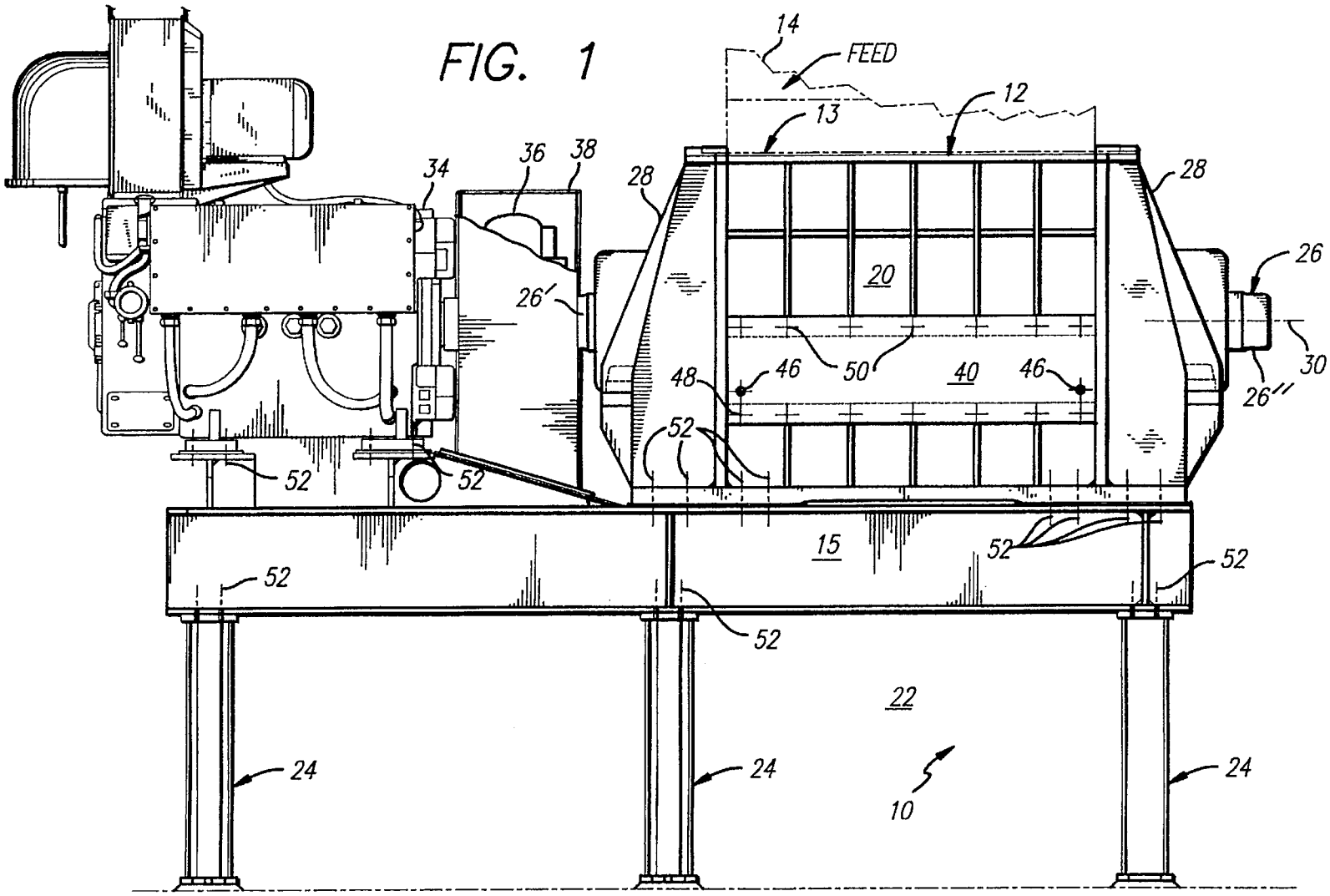
FIGS. 1 and 2 illustrate a improved chopper arrangement according to the principles of the present invention.
Figure 2:
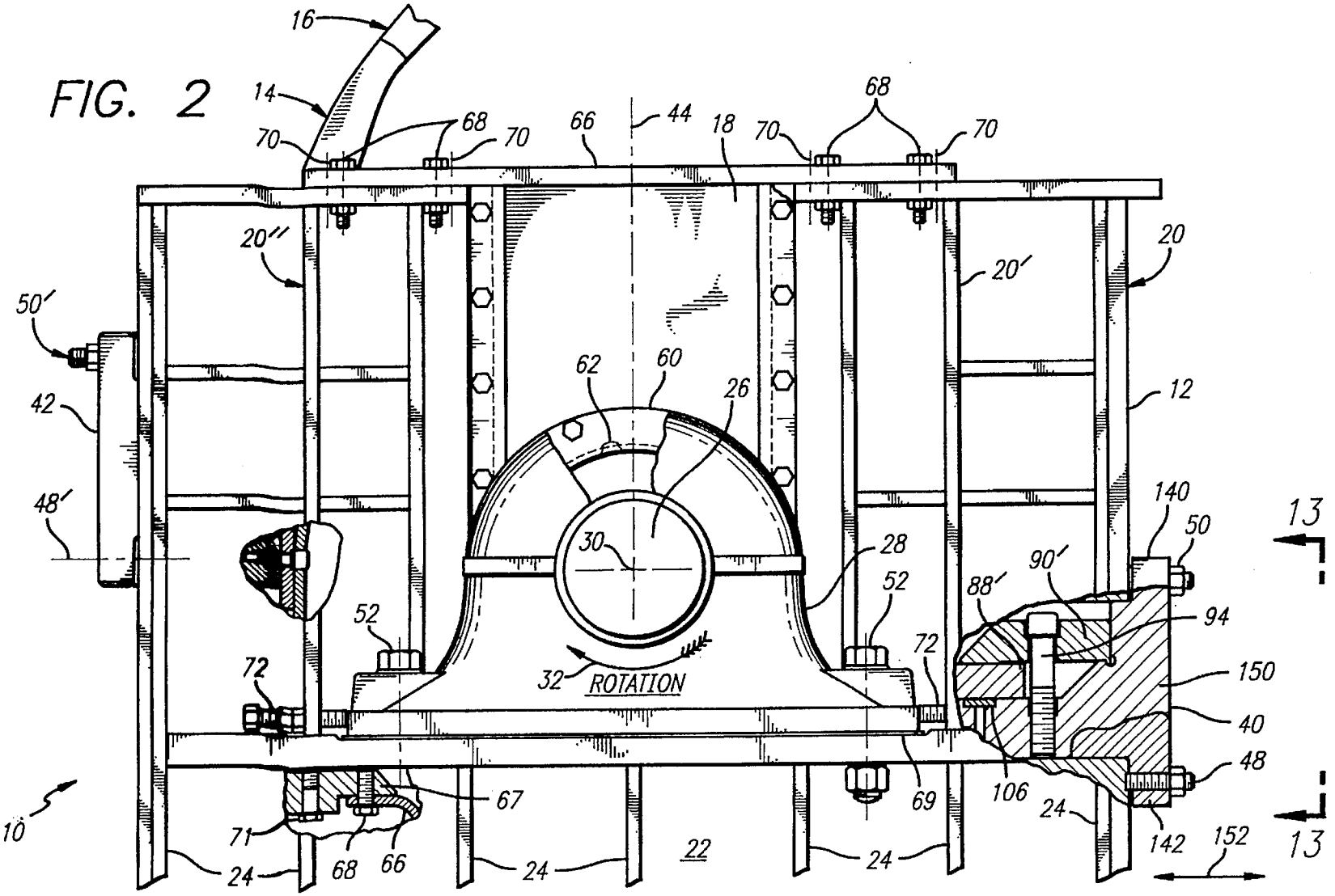

Referring now to the drawing, there is illustrated in FIGS. 1 and 2 a chopper arrangement generally designated 10, according to the principles of the present invention. The chopper 10 is provided with a housing generally designated 12. On the top regions 13 of the housing 12 there is a hood 14 having a feed aperture generally designated 16 through which material to be chopped (not shown) is fed. The housing 12 defines a cavity 18.

The housing 12 has an upper portion generally designated 20 and a lower portion generally designated 22. The lower portion 22 is comprised of a plurality of support legs generally designated 24 which support the upper portion 20 of the housing. Bottom regions, generally designated 15 are at the bottom of the upper portion 20 and the chopped material is removed from the housing 12 from the bottom regions 15 as shown on FIG. 1.

A rotor generally designated 26 is rotatably mounted in the housing 12 on bearing supporting pillow blocks generally designated 28 for rotation about a rotor axis 30 in the direction of rotation indicated in FIG. 2 by the arrow 32.

The rotor is driven in the direction of the arrow 32 in preferred embodiments of the present invention by an electric traction motor generally designated 34 which, for example, may be a General Electric 750 volt DC, 500 horsepower motor. A coupling which, for example, may be a Dodge Paraflex coupling, generally designated 36 couples the motor 34 to the rotor 26. A guard 38 may be provided around the coupling 36.

A first cartridge means generally designated 40 is mounted on the upper portion 20 of the housing 12 for limited reciprocating movement towards and away from the rotor axis 30 as described below in greater detail. A second cartridge means generally designated 42 may be similarly mounted on the housing 12 at the upper portion 20 thereof but on the opposite side of a vertical plane indicated at 44 from the first cartridge means 40.

With the direction of rotation of the rotor 26, as indicated by the arrow 32 and as described below in greater detail, the rotor forces material fed through the feed slot 16 in the hood 14 towards the first cartridge 40 where the primary chopping operation of the material to be chopped takes place.

If desired, coolant may be introduced into the first cartridge 40 as indicated by the coolant apertures 46 on FIG. 1.

A plurality of set screws and nuts as indicated at 48 are utilized by providing the above-described limited reciprocal movement of the first cartridge 40 towards and away from the rotor 26. A plurality of cap screws as indicated at 50 may be utilized for retaining the first cartridge 40 on the housing 12. The second cartridge 42 may be similarly mounted on the housing 20 by set screws indicated at 48' and cap screws as indicated at 50'. The locations of the set screws 48 and cap screws 50 are as indicated on FIG. 1 and as described below in greater detail.

Machine bolts as indicated at 52 may be utilized to bolt the various sections of the housing 12 as well as to retain the pillow blocks 28 on the housing 12 and roller bearings may be utilized in the pillow block 28 for support of the rotor 26. A shaft seal ring generally designated 60 which includes a gasket and a grease seal as indicated at 62 may be provided in connection with the rotor 26, pillow block 28, and bearings contained therein. It will be appreciated that the pillow block 28 which is at the end 26' of the rotor 26 connected to the coupling 36 may be similar to the pillow block 28 in FIG. 2.

The upper portion of the housing 12 may be comprised of two sections 20' and 20" which may be coupled together by connecting brace means 66 by bolts 68. Locating pins (omitted for clarity) may be provided at positions as indicated at 70 on FIG. 2 for appropriate locating of the various components of the housing.

In the lower portion 22 of the housing 12 there may be provided a screen means 66 bolted to a screen mounting body portion 67 by cap screws 68. The screen mounting body portion 67 is coupled to the housing by cap screws 71.

Adjustment for positioning of the pillow blocks 28 may be provided by threaded rods and hex nuts as indicated at 72 which may be welded in place after bolting of the pillow blocks by means of bolts 52 to retain the proper positioning. Shimstock 69 may be utilized as required for proper alignment of the rotor 26.

Figure 3:
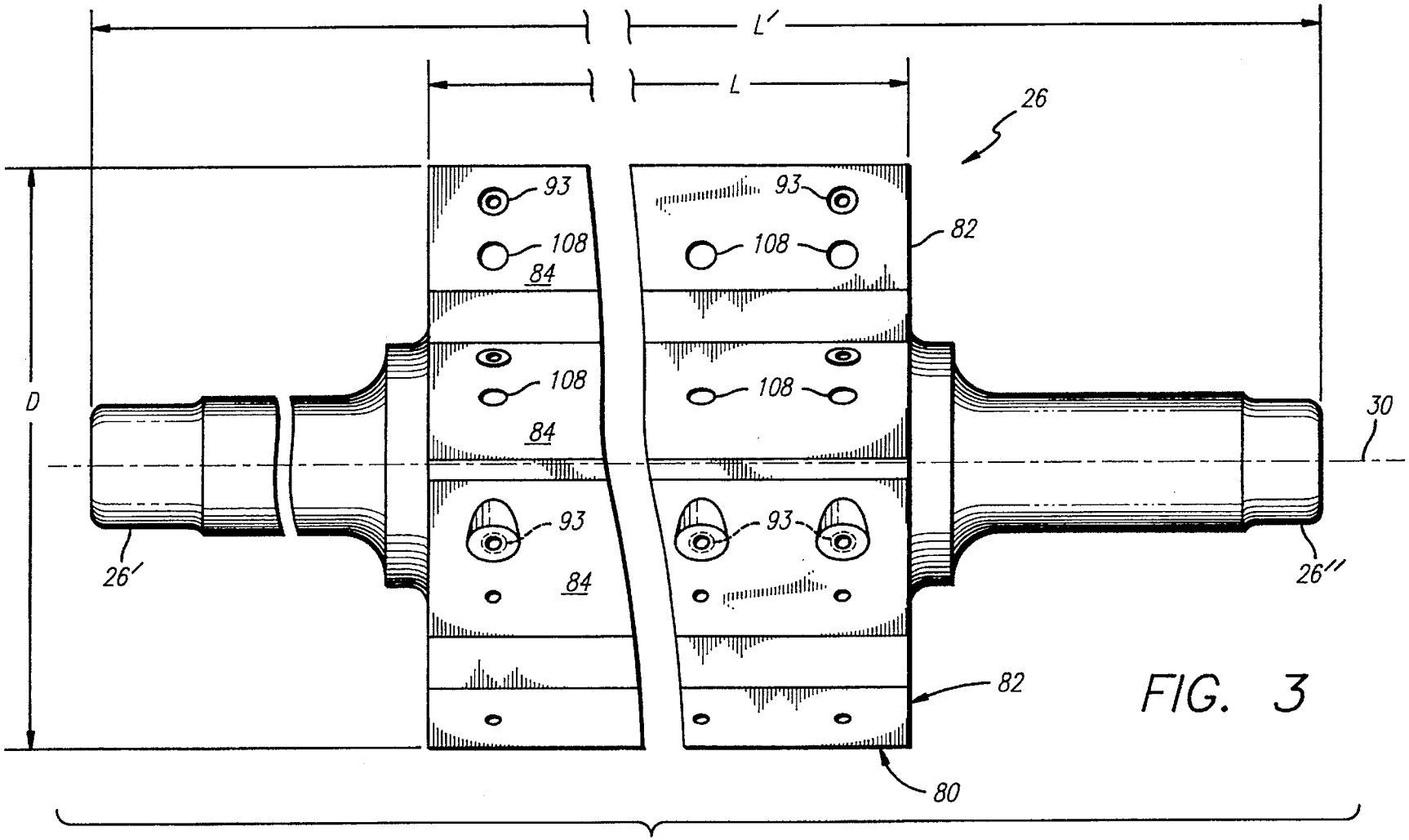
FIGS. 3 and 4 illustrate a rotor means useful in the practice of the present invention.
Figure 4:
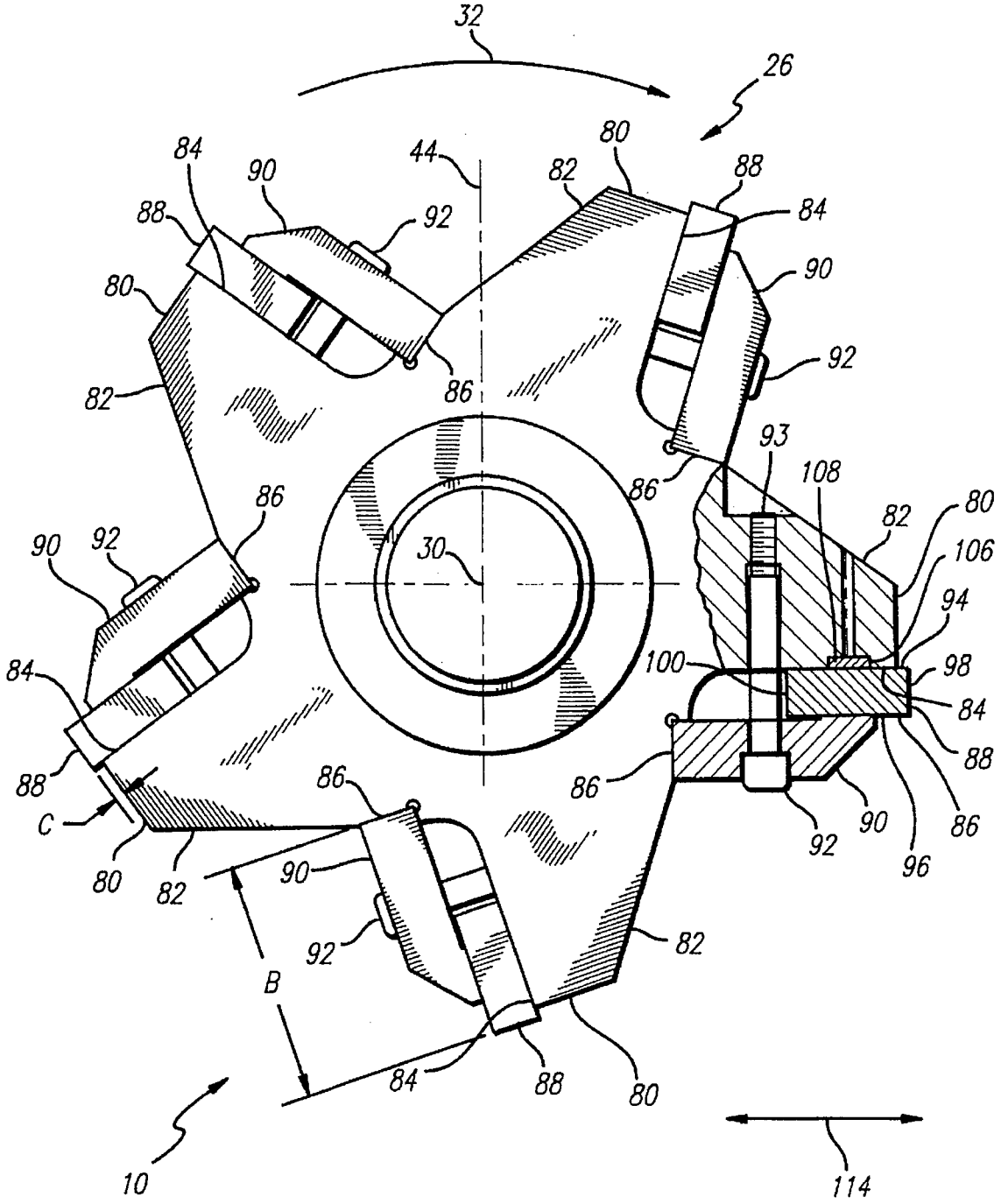

Referring now to FIGS. 3 and 4, there is illustrated the rotor 26 useful in the practice of the present invention. As illustrated in FIG. 3, the rotor 26 has an outer peripheral edge generally designated 80 and a plurality of lobes 82 thereon. In the embodiment 10 the number of lobes 82 provided on rotor 26 is five, though greater or less numbers of lobes maybe utilized.

As shown on FIG. 3, the axial length of the rotor 26 in the preferred embodiments of the present invention may be on the order of four feet as indicated by the letter L. The overall length from the drive end 26' to the free end 26" may be on the order of nine feet as indicated by the dimension L' on FIG. 3. It will be appreciated, however, that greater or smaller lengths of lobed portion of the rotor as indicated by the letter L and the overall length of the letter L' may be selected as required for particular applications. The diameter of the lobed portion of the rotor as indicated by D on FIG. 3 may be on the order of three feet though greater or smaller diameters may be utilized as required for particular applications.

Each of the lobes 82 on the rotor 26 is provided with a blade face generally designated 84 which extend inwardly from the outer peripheral edge a preselected distance as indicated on FIG. 4 by the letter B. Each of the lobes 82 are fabricated similarly and have an interior shoulder generally designated 86.

A rotor cutting blade means generally designated 88 is mounted on the blade face 84 of each of the lobes 82 of the rotor 26.

A rotor cutting blade hold-down bar means generally designated 90 is provided at each of the lobes 82.

Rotor cutting blade retention means generally designated 92 are provided at each of the lobes 82 and generally comprise screw means extending through the rotor cutting blade hold-down bar means 90 and threadingly engaging the lobes 82 as indicated at 94. The screws 92 are free of engagement, in preferred embodiments of the present invention, with the rotor cutting blade 88 so that the rotor cutting blade 88 is clampingly retained between the rotor cutting blade hold-down bar means 90 and the blade face 84 of each of the lobes 82. As shown most clearly on FIG. 4, the rotor cutting blades 88 extend outwardly from the peripheral edge at each of the lobes 82 a distance as indicated at C.

Figure 5:
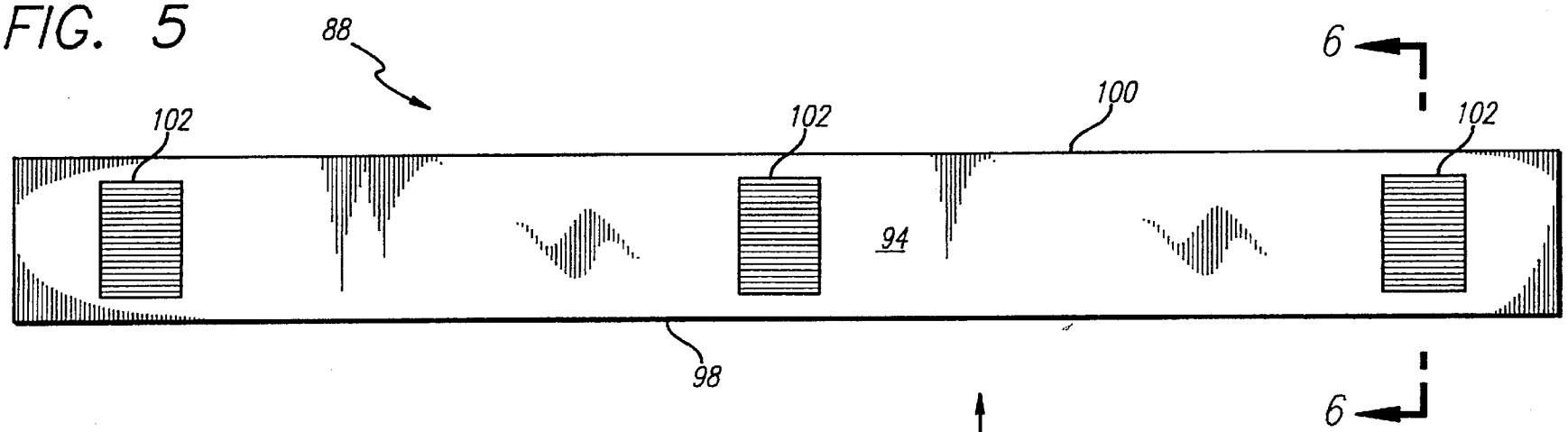
FIG. 5 illustrates a cutting blade which may be utilized for both a rotor cutting blade and a cartridge cutting blade in the practice of the present invention.
Figure 6:
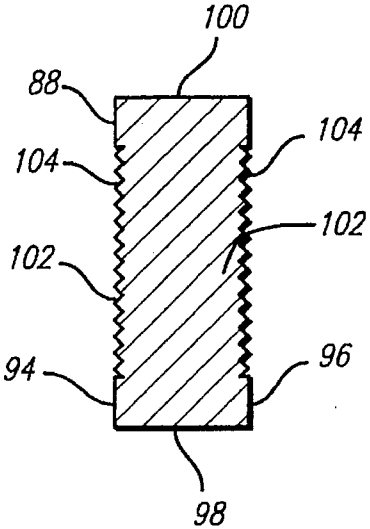
FIG. 6 is a sectional view along the lines 6—6 of FIG. 5.

The rotor cutting blade 88 is illustrated in FIGS. 5 and 6. As shown thereon, the rotor cutting blade 88 is generally rectangular in cross-section and may be fabricated, for example, of steel and has a first surface generally designated 94 which, for the blade as positioned in FIG. 4, is adjacent the blade face 84 of the lobes 82. The rotor cutting blades 88 also have a second surface 96 spaced apart from the first surface 94 and an outer surface 98 and an inner surface 100 and each of the outer face 98 and inner face 100 intersect each of the first faces 94 and second faces 96 of each of the rotor cutting blades 88.

Figure 9:
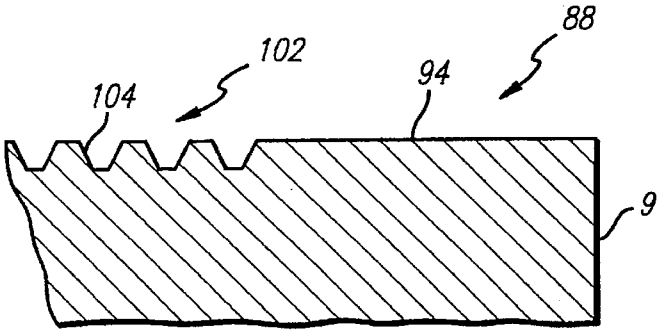
FIGS. 9 and 10 illustrate the serrations for the blade indexing means and the locating button useful in the practice of the present invention.
Figure 10:
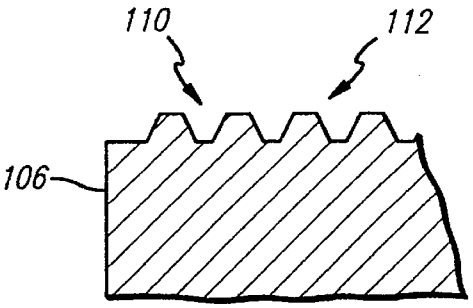

Rotor cutting blade indexing means generally designated 102 are provided on each of the surfaces 94 and 96 of the blade 88 and, as shown on FIG. 5, there are three separate rotor cutting blade indexing means are provided in spaced apart axial relationship. Each of the rotor cutting blade indexing means, as illustrated in FIG. 9, comprises a plurality of serrations generally designated 104 for purposes hereinafter described.

It will be appreciated that because of the rectangular cross-section of the blade 88 as shown, for example, in FIG. 6, each of the surfaces 98 and 100 may be positioned to be the outermost surface and each of the surfaces 94 and 96 may be positioned against the blade face 84 of the lobe 82 of the rotor 26.

Figure 7:
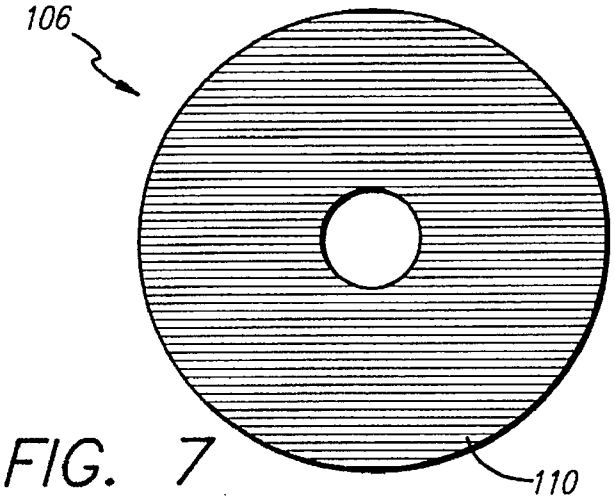
FIGS. 7 and 8 illustrate a locating button useful in the practice of the present invention.
Figure 8:
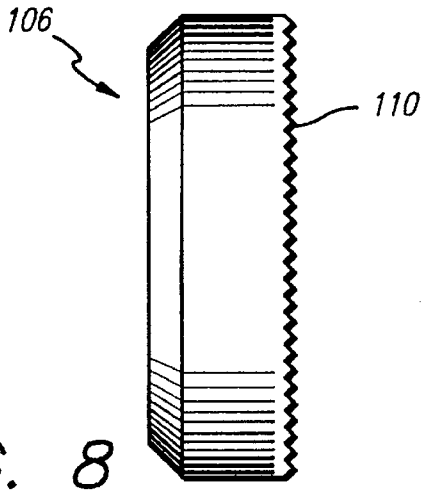

Each of the blade faces 84 of the lobes 82 is provided with rotor cutting blade locating means generally indicated at 106 (FIG. 4). In the embodiment 10 the rotor cutting blade locating means may comprise a plurality of locating buttons as illustrated in FIGS. 7 and 8 fitting into a cavity defined by walls generally designated 108 (FIG. 3) in the blade faces 84 of the lobes 82. The locating buttons 106, as shown in FIGS. 7 and 8, are generally sections of a right circular cylinder and are provided with an outer face generally designated 110 having serrations generally designated 112 that are configured to interengage with the serrations 104 in the blades 88. Thus, the serrations 112 in the locating buttons 106 project slightly above the surface of the blade face 84 of the lobes 82 on rotor 26 so that engagement with the serration 102 on the blade 88 may be made.

To provide proper alignment of the blades 88, the serrations 102 in the three locations shown on FIG. 5, are in the regions of the three locating buttons 106 on the blade faces 84 of the lobes 82.

Figure 11:
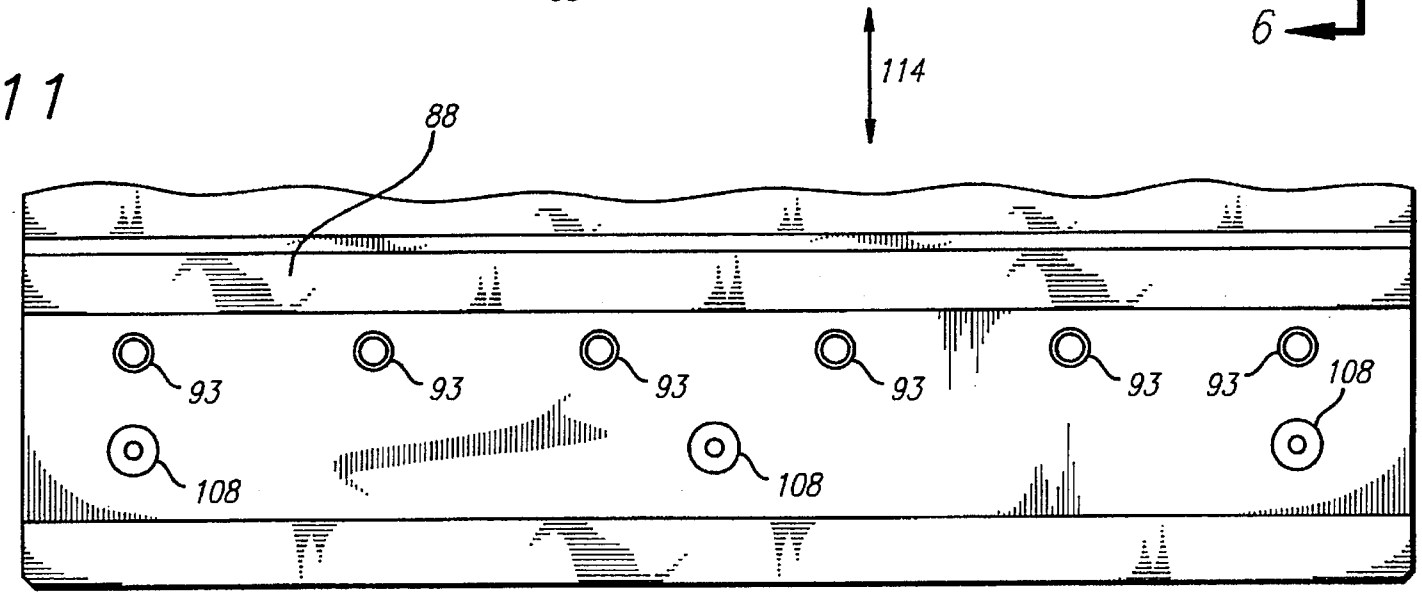
FIG. 11 illustrates the blade mounting face of the rotor and cartridge means according to the principles of the present invention.

FIG. 11 illustrates blade faces showing the location of the walls 108 in the rotor cutting blade mounting face 84 defining the cavities in which the locating buttons 106 are positioned and the threaded apertures 93 for threading engagement with the bolts 92 in order to clamp the hold-down bar means 90 firmly against the rotor cutting blade 88.

Since the bolts 92 do not extend through the rotor cutting blades 88 and the rotor cutting blades 88 are clampingly retained on the blade faces 84 of the lobes 82, loosing of the bolts 92 allows the blade 88 to be moved reciprocatingly as desired in the directions indicated by the double-ended arrow 114 towards and away from the plane 44 (FIG. 4). The movement of the blades 88 in the directions indicated by the arrow 114 is incremental depending upon the pitch of the serrations 102 in the blade 88 and the serrations 112 in the locating button 106. The interengaging serrations on the locating buttons 106 and indexing means 102 also provides precise axial alignment of the rotor cutting blade 88 so that the separation between the rotor cutting blade 88 and the fixed blade 88' (FIG. 2) is constant.

Similarly, when the outer surface such as 98 illustrated in FIG. 4 and/or the intersection of the outer surface 98 with the surface 96 becomes dull due to the chopping operation, the entire blade may be rotated so that the surface 100 is the outermost surface or, alternatively, the blade may be inverted so that the face 96 is positioned adjacent the blade face 84 of the lobe 82 of the rotor 26. Consequently, changing the position of the rotor cutting blade 88, both in reciprocating directions as indicated by the arrow 114 as well as reversing the blade as cutting surfaces become dull, may be quickly and conveniently done by merely loosing the bolts 92 to relieve the clamping action of the hold-down bar 90.

Figure 12:
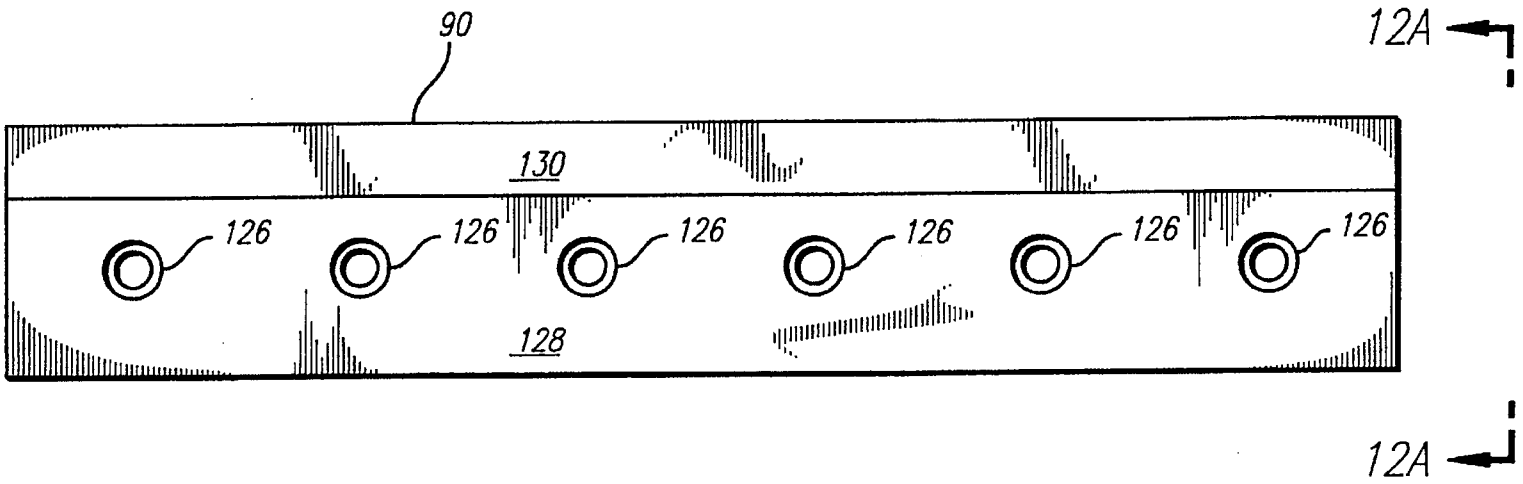
FIGS. 12 and 12*a* illustrate a blade hold-down bar according to the principles of the present invention.
Figure 12A:
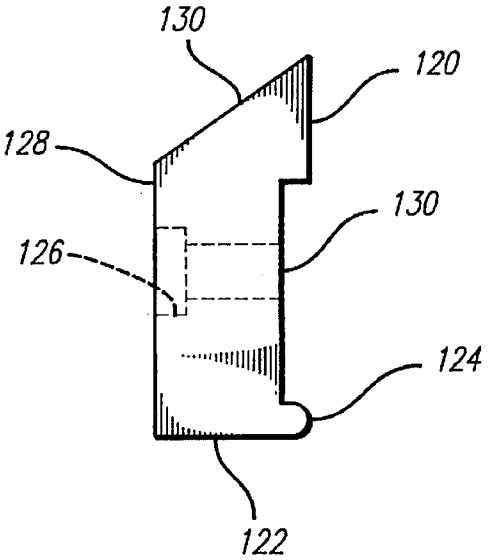

FIGS. 12 and 12*a* illustrate the hold-down bar 90 according to the principles of the present invention. As shown on FIGS. 12 and 12*a*, the rotor cutting blade hold-down bar means 90 has a rotor cutting blade engagement portion 120 which clampingly engages the rotor cutting blade 88. As shown in FIG. 4, the engagement of the hold-down bar 90 with the rotor cutting blade 88 is preferably axially aligned with the locating buttons 106. An inner end 122 of the hold-down bar means 90 is provided with a shoulder-engaging portion 124 which engages the shoulder 86 of the rotor cutting face 84 on the lobes 82 of the rotor 26. The rotor cutting blade hold-down bar means 90 has walls 126 defining a plurality of apertures extending from a first surface 128 to the second surface 130. As shown on FIGS. 12 and 12*a*, the number of such apertures is six and the bolts 92 extend through the apertures 126 for the threading engagement at 93 with the lobes 82 of the rotor 26 (FIG. 2). In preferred embodiments of the present invention, the rotor cutting blade hold-down bar means 90 has a chamfered outer face 130. This provides sufficient clearance action during the chopping operation to prevent interference with the stationary blade contained within the cartridge 40 and, if provided, the cartridge 42.

Figure 13:
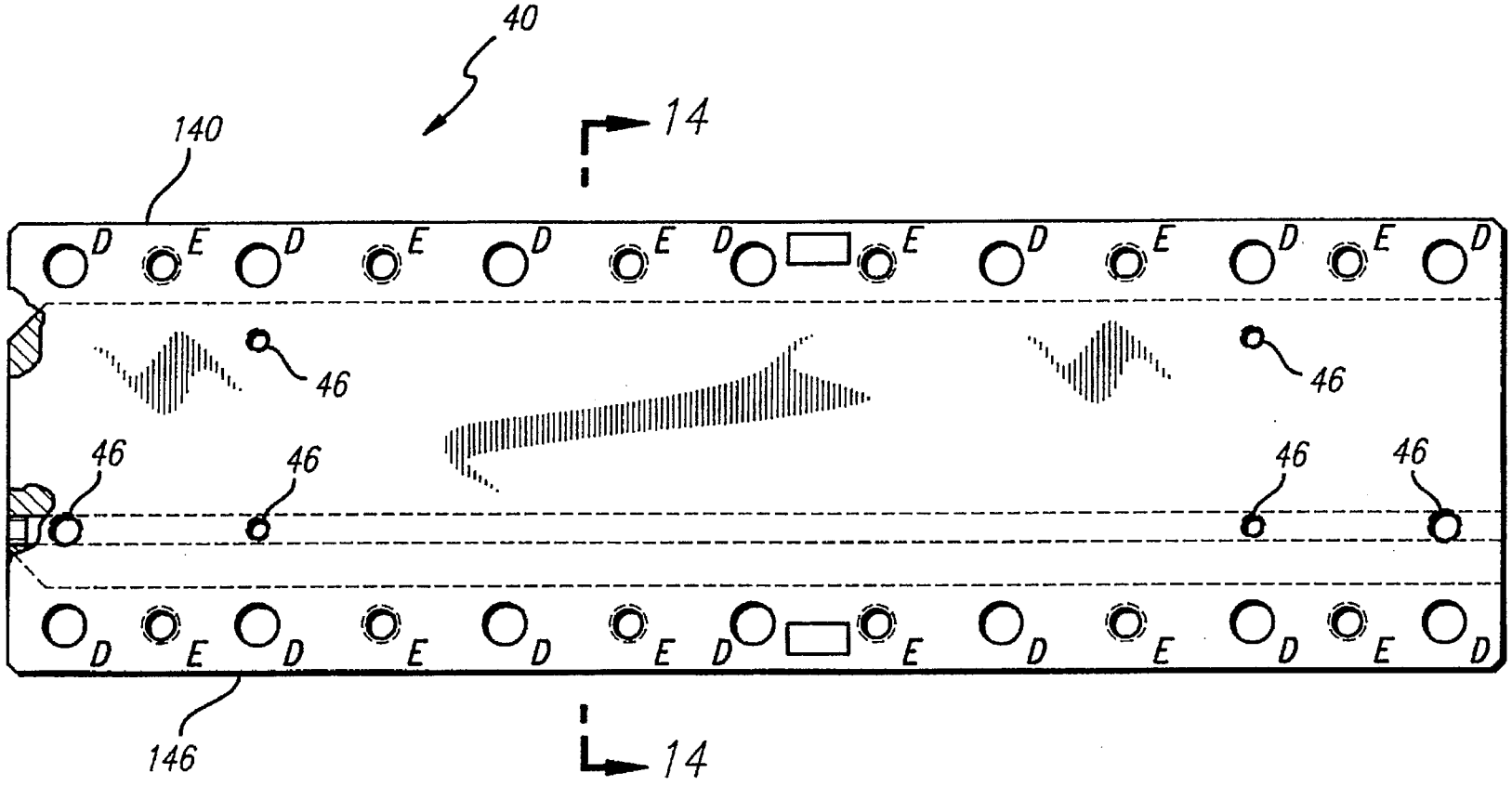
FIGS. 13 and 14 illustrate a first cartridge means useful in the practice of the present invention.

As noted above, the housing 12 is provided with a first cartridge means 40. As shown on FIG. 2, an upper portion generally designated 140 and a lower portion generally designated 142 of the first cartridge means 40 are provided with set screws 48 and cap screws 50. As shown on FIG. 13, in each of the upper portion 140 and lower portion 146, the first cartridge 40 is provided with a plurality of apertures therethrough generally indicated at D in the upper portion 140 and lower portion 146 for accepting the cap screws 50 which extend therethrough and bolt into the housing 12. Alternating with each of the apertures indicated by the letter D are apertures indicated by the letter E for accommodating the set screws 48 which threadingly engage the first cartridge means 40 and bear against a wall of the housing 12 as shown most clearly in FIG. 2. The apertures for the set screws 48 are indicated by the letter E on FIG. 13. Further, as noted above, coolant apertures such as those indicated at 46 may be provided to provide cooling to the first cartridge 40.

Figure 14:
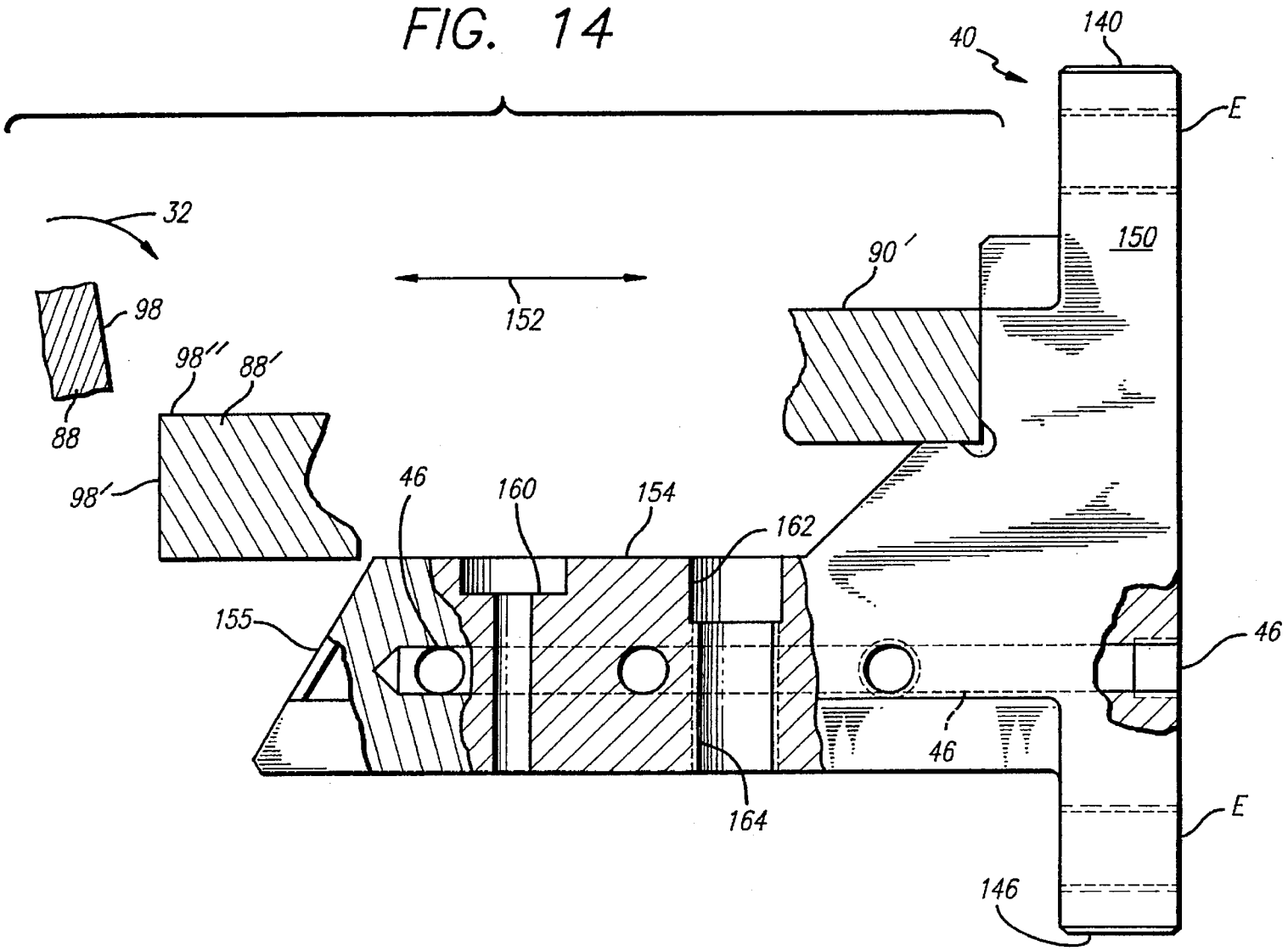

As shown most clearly in FIG. 14, the first cartridge means 40 generally has a cartridge body generally designated 150 which, by means of the set screws 48 mounted in the apertures E, may be moved reciprocally towards and away from the rotor 26 and rotor cutting blades 88 in the directions indicated by the arrow 152. The cartridge body 150 has a cartridge cutting blade mounting face generally designated 154 for supporting the cartridge cutting blade 88' which may be substantially identical to the rotor cutting blade 88 described above. The cartridge cutting blade 88' is clamped to the cartridge cutting blade face 154 of the cartridge body 150 of the first cartridge means 40 by a cartridge cutting blade hold-down bar means 90' which may be substantially identical to the rotor cutting blade hold-down bar means 90 described above. The cartridge cutting blade mounting face 154 has walls defining apertures 160 therein. Cartridge cutting blade locating means which may comprise a plurality of locating buttons which are substantially identical to the locating buttons 106 described above in connection with FIGS. 7 and 8 so that the serrated face 110 thereof faces towards the cartridge cutting blade 88'. The cartridge cutting blade 88' has cartridge cutting blade indexing means which may be the same as illustrated in FIG. 5 in connection with the rotor cutting blade 88 for positioning above the plurality of locating buttons 106 located in the apertures 160. The cartridge body 150 is also provided with apertures 162 which are threaded as indicated at 164 for receiving screws which may be similar to the screws 92 described above in connection with FIG. 4 for clamping the cartridge blade hold-down bar means 90' against the cartridge cutting blade 88'.

As shown on FIG. 14, for the rotor cutting blade 88 rotating in the direction indicated by the arrow 32, it passes in material chopping relationship to the cartridge cutting blade 88' adjacent the surface 98' thereof. Since the rotor 26 has five lobes and, therefore, five rotor cutting blades 88, the surface 98' and the corner 98" thereof where the surface 98' intersects the surface 88' receives five times as much wear as any one rotor blade 88 during each revolution of the rotor 26. Consequently, adjustments for wear of the cartridge cutting blade 88" must be done more frequently than adjustments of the rotor cutting blade 88 in order to maintain the proper material chopping relationship therebetween. The provisions of the set screws 48 for providing the reciprocating movement of the cartridge means 40 in the direction indicated by the arrow 152 may be conveniently done without entering the cavity 18 of the housing 12. The adjustments of the first cartridge means 40 in the directions indicated by the arrow 152 utilizing the set screws 48 and cap screws 50 does not require loosening of the screws 94 which provide the clamping force between the cartridge cutting blade hold-down bar means 90' and cartridge cutting blade 88'. However, when sufficient adjustment because of wear, or otherwise, cannot be made by means of the set screws 48 and cap screws 50, the rotation of the rotor 26 may be stopped and the cavity 18 entered. Changing of the cartridge cutting blade 88' by incremental adjustment according to the pitch of the serrations in the locating buttons 106 positioned in the cavities 160 in engagement with the cartridge cutting blade indexing means may be made by loosening of the screws 94. Similarly, reversal and/or rotation of the cartridge cutting blade 88' may also be made.

Utilization of the set screws 48 and cap screws 50 to provide the reciprocating motion of the entire first cartridge means 40 in the direction of the arrows 152 may, if desired, be done without stopping rotation of the rotor 26. This is advantageous since, in those embodiments where a very massive rotor, the slow down and start up time can be extensive.

Figure 15:
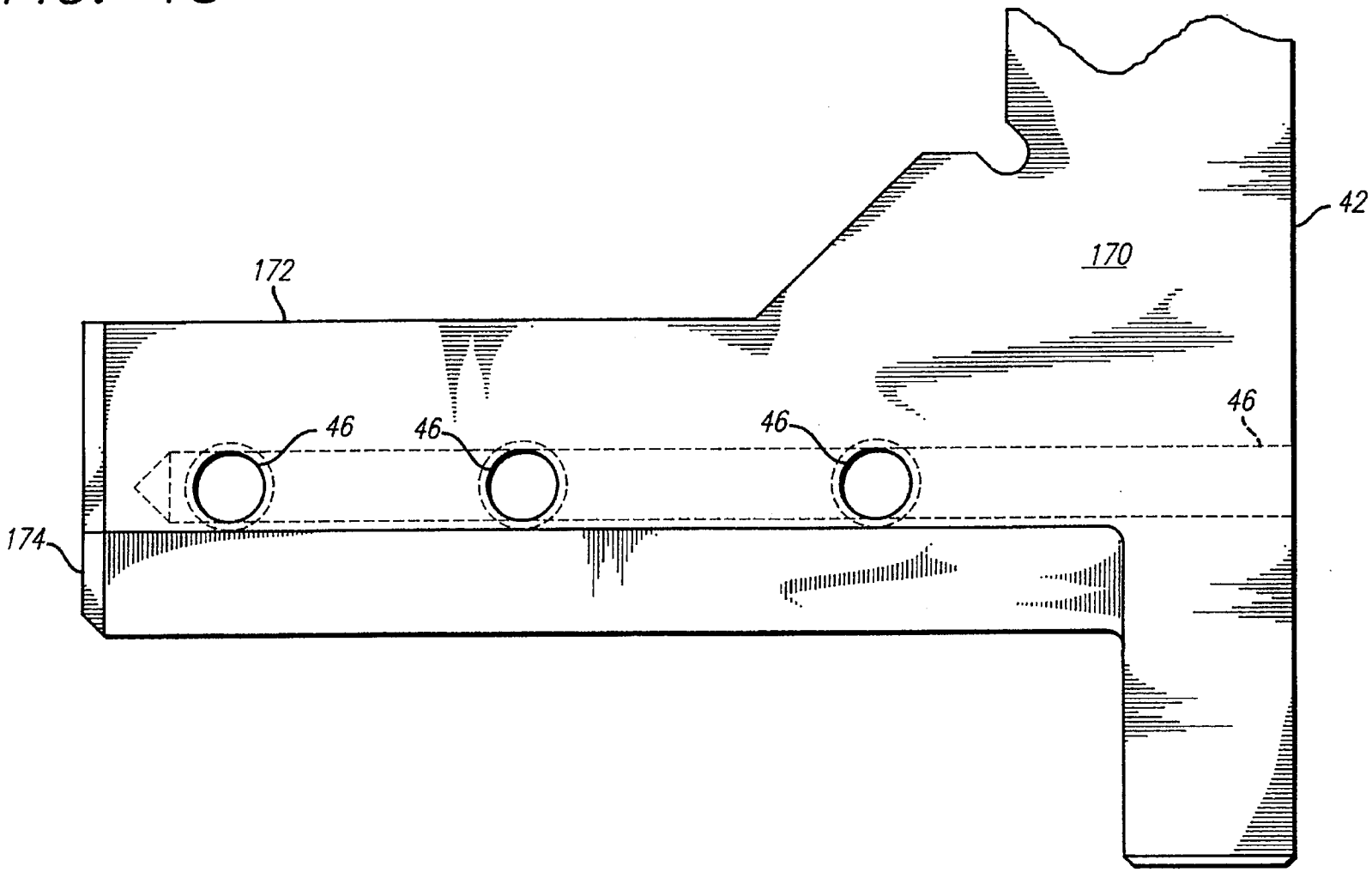
FIG. 15 illustrates a second cartridge means useful in the practice of the present invention.

A second cartridge means 42, as shown on FIG. 2, may be provided on the opposite side of the plane 44 from the first cartridge means 40. The second cartridge means 42 may be generally similar to the first cartridge means 40 and, as shown on FIG. 15, the second cartridge means 42 has a body generally designated 170 and has a cartridge cutting blade mounting face generally designated 172 for supporting a cartridge cutting blade (not shown) thereon which may be similar to the cartridge cutting blade 88' which is clampingly held against the cartridge cutting blade mounting face 172 by a cartridge cutting blade hold-down bar means (not shown) which may be similar to the cartridge cutting blade hold-down bar means 90'. The cartridge 40 has on a chamfered interior face generally designated 155 in preferred embodiments. However, the inner face 174 of the second cartridge 42 may, if desired, not be chamfered most of the cutting action occurs at the first cartridge means 42.

This concludes the description of the preferred embodiment of the present invention. It will be appreciated that those skilled in the art may find many variations intended to cover all such variations and adaptations falling within the true scope and spirit thereof.

The invention has been described in considerable detail in order to comply with the patent laws by providing a full public disclosure of at least one of its forms. However, such detailed description is not intended in any way to limit the broad features or principals of the invention, or the scope of patent monopoly to be granted.

I claim:

1. In an improved chopper arrangement, the improvement comprising, in combination:

a housing means;

a rotor means rotatably mounted on said housing means for rotation in a preselected direction about a rotor axis and having an outer peripheral edge;

said rotor means comprising:

a plurality of lobes on said outer peripheral edge of said rotor means and said lobes extending axially a first preselected distance;

each of said lobes having:

a blade face extending a second preselected distance inwardly from said outer peripheral edge;

rotor cutting blade locating means on said blade face of each of said lobes, said rotor cutting blade locating means further comprises:

walls in said blade face of said lobes defining locating button receiving cavities;

a plurality of locating buttons, one of said plurality of locating buttons positionable in each of said locating button receiving cavities, and each of said plurality of locating buttons having an outer face projecting a third preselected distance above said blade face of said lobes, and said outer faces of said plurality of locating buttons having a plurality of serrations therein;

rotor cutting blade means mounted on each of said blade faces of said rotor means for limited reciprocal movement towards and away from said outer peripheral edge and having rotor cutting blade indexing means for alignment with said rotor cutting blade locating means on said blade faces of said rotor means, and said rotor cutting blade means having:

a first surface adjacent said blade faces;

a second surface spaced from said first surface;

an outer surface extending between and intersecting each of said first and said second surfaces, and said outer surface extending a fourth preselected distance outwardly from said outer peripheral edge of said rotor means, and said rotor cutting blade means substantially rectangular in cross-section;

rotor cutting blade hold-down bar means adjacent said second surfaces of each of said rotor cutting blade means;

rotor cutting blade retention means for engaging said rotor cutting blade hold-down bar means and said lobes of said rotor means for clamping retention of said rotor cutting blade means on said lobes of said rotor means.

2. The arrangement defined in claim 1 and further comprising:

drive means for rotating said rotor means in said preselected direction about said rotor axis.

3. The arrangement defined in claim 2, wherein:

said drive means for rotating said rotor means in said preselected direction about said rotor axis comprises an electric motor.

4. The arrangement defined in claim 1, wherein:

said rotor cutting blade retention means of said rotor cutting blade means further comprises:

screw means extending through said rotor cutting blade hold-down bar means of said rotor cutting blade means for threading engagement with said lobes of said rotor means.

5. The arrangement defined in claim 4, wherein:

said screw means is free of engagement with said rotor cutting blade means of said lobes, whereby said rotor cutting blade means is detachably clamped between said rotor cutting blade hold-down bar means of said rotor cutting blade means and said lobes of said rotor means.

6. The arrangement defined in claim 1 wherein:

said rotor cutting blade indexing means of said rotor cutting blade means further comprises:

a plurality of serrations in said first surface of said rotor cutting blade means on said lobes for engagement with said serrations in said outer face of said locating buttons of said rotor cutting blade locating means.

7. The arrangement defined in claim 6, further comprising:

drive means for rotating said rotor means in said preselected direction about said rotor axis.

8. The arrangement defined in claim 7, wherein:

said drive means for rotating said rotor means in said preselected direction about said rotor axis comprises an electric motor.

9. The arrangement defined in claim 7, wherein:

said rotor cutting blade retention means of said rotor cutting blade means further comprises:

screw means extending through said rotor cutting blade hold-down bar means of said rotor cutting blade means for threading engagement with said lobes of said rotor means.

10. The arrangement defined in claim 9, wherein:

said screw means is free of engagement with said rotor cutting blade means of said lobes, whereby said rotor cutting blade means is detachably clamped between said rotor cutting blade hold-down bar means of said rotor cutting blade means and said lobes of said rotor means.

11. The arrangement defined in claim 1, wherein:

said plurality of locating buttons of said rotor cutting blade locating means are in an axially extending, linear, spaced apart array on each of said blade faces of said lobes.

12. The arrangement defined in claim 11, wherein:

said plurality of locating buttons of said rotor cutting blade locating means are sections of right circular cylinders.

13. The arrangement defined in claim 12 wherein:

said rotor cutting blade indexing means of said rotor cutting blade means further comprises:

a plurality of serrations in said first surface of said rotor cutting blade means of said lobes for engagement with said serrations in said outer face of said locating buttons of said rotor cutting blade locating means.

14. In an improved chopper arrangement, the improvement comprising, in combination:

housing means having external walls defining an internal cavity for rotatably supporting a rotor means in said cavity for rotation of said rotor means about a rotor axis in a preselected direction;

a first cartridge means comprising:

a cartridge body movably mounted on said external walls of said housing means for limited linear reciprocating motion towards and away from said rotor means and having an inner surface positionable in a preselected spaced relationship to said rotor means, and an outer surface exterior said housing means;

said cartridge body comprising:

a cartridge cutting blade mounting face extending inwardly from regions adjacent said external walls of said housing means into said cavity in said housing means;

cartridge cutting blade locating means on said cartridge cutting blade mounting face, said cartridge cutting blade locating means further comprises:

walls in said cartridge cutting blade mounting face of said cartridge body defining locating button receiving cavities; and a plurality of locating buttons, one of said plurality of locating buttons positionable in each of said locating button receiving cavities, and each of said plurality of locating buttons having an outer face projecting above said cartridge cutting blade mounting face of said cartridge body, and said outer faces of said plurality of locating buttons having a plurality of serrations therein;

cartridge cutting blade means mounted on said cartridge cutting blade mounting face of said cartridge body for limited linear reciprocal movement towards and away from said rotor means, and said cartridge cutting blade means having cartridge cutting blade indexing means for alignment with said cartridge cutting blade locating means, and said cartridge cutting blade means having:

a first surface adjacent said cartridge cutting blade mounting face of said cartridge body;

a second surface spaced from said first surface;

an inner surface extending between and intersecting each of said first surface and said second surface and in opposed relationship to said rotor means, and selectively positionable in preselected spaced relationship to said rotor means;

cartridge cutting blade hold-down bar means adjacent said second surface of said cartridge cutting blade means;

cartridge cutting blade retention means for engaging said cartridge cutting blade hold-down bar means and said cartridge body for clampingly mounting said cartridge cutting blade means on said cartridge body; and adjustment means for selectively moving said first cartridge means towards and away from said rotor means.

15. The arrangement defined in claim 14, and further comprising:

drive means for rotating said rotor means in said internal cavity of said housing means in said preselected direction about said rotor axis.

16. The arrangement defined in claim 15, wherein:

said drive means for rotating said rotor means in said internal cavity of said housing means comprises an electric motor.

17. The arrangement defined in claim 14, wherein:

said cartridge cutting blade retention means of said cartridge cutting blade means further comprises:

screw means extending through said cartridge cutting blade hold-doom bar means of said cartridge cutting blade means for threading engagement with said cartridge body.

18. The arrangement defined in claim 17, wherein:

said screw means is free of engagement with said cartridge cutting blade means, whereby said cartridge cutting blade means of said first cartridge means is detachably clamped between said cartridge cutting blade hold-down bar means of said cartridge cutting blade means and said cartridge body.

19. The arrangement defined in claim 17, wherein:

said cartridge cutting blade indexing means of said cartridge cutting blade means further comprises:

a plurality of serrations in said cartridge cutting blade means for engagement with said serrations in said outer face of said locating buttons of said cartridge cutting blade locating means.

20. The arrangement defined in claim 19, further comprising:

drive means for rotating said rotor means in said internal cavity of said housing means about said rotor axis in said preselected direction.

21. The arrangement defined in claim 14, wherein:

said plurality of locating buttons of said cartridge cutting blade locating means are in an axially extending linear spaced apart array on said cartridge cutting blade mounting face of said cartridge body.

22. The arrangement defined in claim 21, wherein:

said plurality of locating buttons of said cartridge cutting blade locating means are sections of right circular cylinders.

23. The arrangement defined in claim 22, wherein:

said cartridge cutting blade indexing means of said cartridge cutting blade means further comprises:

a plurality of serrations in said cartridge first surface of said cutting blade means of said first cartridge means for engagement with said serrations in said outer faces of said plurality of locating buttons.

24. The arrangement defined in claim 14, and further comprising:

said rotor means rotatably mounted in said housing means for said rotation in said preselected direction about said rotor axis has an outer peripheral edge; and said rotor means comprising:

a plurality of lobes on said outer peripheral edge of said rotor means and said lobes extending axially a first preselected distance;

each of said lobes having:

a blade face extending a second preselected distance inwardly from said outer peripheral edge;

rotor cutting blade locating means on said blade face of each of said lobes;

rotor cutting blade means mounted on each of said blade faces of said rotor means for limited reciprocal movement towards and away from said outer peripheral edge and having rotor cutting blade indexing means for alignment with said rotor cutting blade locating means on said blade faces of said rotor means, and said rotor cutting blade means having:

a first surface adjacent said blade faces;

a second surface spaced from said first surface;

an outer surface extending between and intersecting each of said first and said second surfaces, and said outer surface extending a third preselected distance outwardly from said outer peripheral edge of said rotor means, and said rotor cutting blade means substantially rectangular in cross-section;

rotor cutting blade hold-down bar means adjacent said second surfaces of each of said rotor cutting blade means;

rotor cutting blade retention means for engaging said rotor cutting blade hold-down bar means and said lobes of said rotor means for clamping retention of said rotor blade means on said lobes of said rotor means whereby said rotor cutting blade means passes in material-severing relationship to said cartridge cutting blade means.

25. The arrangement defined in claim 24 wherein:

said cartridge cutting blade hold-down bar means of said cartridge cutting blade means further comprises a chamfered inner face in opposed relationship to said rotor means.

26. The arrangement defined in claim 24, wherein:

said rotor cutting blade retention means of said rotor cutting blade means further comprises:

screw means extending through said rotor cutting blade hold-down bar means of said rotor cutting blade means for threading engagement with said lobes of said rotor means;

said cartridge cutting blade retention means of said cartridge cutting blade means further comprises:

screw means extending through said cartridge cutting blade hold-down bar means of said cartridge cutting blade means for threading engagement with said cartridge body.

27. The arrangement defined in claim 26, wherein:

said screw means of said rotor cutting blade retention means is free of engagement with said rotor cutting blade means, whereby said rotor cutting blade means is detachably clamped between said rotor cutting blade hold-down bar means and said lobes of said rotor means;

said screw means of said cartridge cutting blade retention means is free of engagement with said cartridge cutting blade means, whereby said cartridge cutting blade means is detachably clamped between said cartridge cutting blade hold-down bar means and said cartridge body.

28. The arrangement defined in claim 24, wherein:

said rotor cutting blade locating means of said rotor means further comprises:

walls in said blade face of said lobes defining locating button receiving cavities:

a plurality of locating buttons for said rotor cutting blade means, one of said plurality of locating buttons positionable in each of said locating button receiving cavities, in said blade phase of said lobes and each of said plurality of locating buttons having an outer face projecting a fourth preselecteddistance above said blade face of said lobes, and said outer faces of said plurality of locating buttons having a plurality of serrations therein.

29. The arrangement defined in claim 28, wherein:

said rotor cutting blade indexing means of said rotor cutting blade means further comprises:

a plurality of serrations in said first surface of said rotor cutting blade means of said lobes for engagement with said serrations in said outer face of said plurality of locating buttons of said rotor cutting blade locating means;

said cartridge cutting blade indexing means of said cartridge cutting blade means further comprises:

a plurality of serrations in said cartridge cutting blade means for engagement with said serrations in said outer faces of said plurality of locating buttons in said cartridge cutting blade locating means.

30. The arrangement defined in claim 24 and further comprising:

drive means for rotating said rotor means in said preselected direction about said rotor axis.

31. The arrangement defined in claim 30, wherein:

said drive means further comprises an electric motor for rotating said rotor means in said preselected direction about said rotor axis.

32. The arrangement defined in claim 24, wherein:

said plurality of locating buttons of said rotor cutting blade locating means are in an axially extending, linear, spaced apart array on each of said blade faces of said lobes;

said plurality of locating buttons of said cartridge cutting blade locating means are in an axially extending linear spaced apart array on said cartridge cutting blade mounting face of said cartridge body.

33. The arrangement defined in claim 32, wherein:

said plurality of locating buttons of said rotor cutting blade locating means are sections of right circular cylinders;

said plurality of locating buttons of said cartridge cutting blade locating means are sections of right circular cylinders.

34. The arrangement defined in claim 33, wherein:

said rotor cutting blade indexing means further comprises:

a plurality of serrations in said first surface of said rotor cutting blade means of said lobes for engagement with said serrations in said outer face of said plurality of locating buttons of said rotor cutting blade locating means;

said cartridge cutting blade indexing means of said cartridge cutting blade means further comprises:

a plurality of serrations in said cartridge cutting blade means for engagement with said serrations in said outer faces of said plurality of locating buttons in said cartridge cutting blade locating means.

35. The arrangement defined in claim 14, wherein:

said adjustment means of said cartridge body of said first cartridge means further comprises:

a plurality of set screws extending through said cartridge body means and engaging said housing means for providing limited linear reciprocating motion of said first cartridge means towards and away from said housing means.

36. In an improved chopper arrangement the improvement comprising, in combination:

a housing means having external walls defining an internal cavity for rotatably supporting a rotor means in said cavity for rotation of said rotor means about a rotor axis in a first direction;

a first cartridge means and a second cartridge means each having a cartridge body means and movably mounted on said external walls of said housing means for limited linear reciprocated motion towards and away from said housing means and each of said first cartridge means and said second cartridge means having an inner surface in spaced relationship to said rotor means and in spaced apart relationship to each other;

each of said cartridge body means of said first cartridge means and said second cartridge means comprising:

a cartridge cutting blade mounting face extending inwardly from regions adjacent said external walls of said housing means into said internal cavity in said housing means;

cartridge cutting blade locating means on said cartridge cutting blade mounting face, said cartridge cutting blade locating means further comprises:

walls in said cartridge cutting blade mounting face of said cartridge body defining locating button receiving cavities; and a plurality of locating buttons one of said plurality of locating buttons positionable in each of said locating button receiving cavities, and each of said plurality of locating buttons having an outer face projecting above said cartridge cutting blade mounting face of said cartridge body, and said outer faces of said plurality of locating buttons having a plurality of serrations therein;

cartridge cutting blade means mounted on said cartridge cutting blade mounting face of each of said cartridge body means for limited linear reciprocal movement towards and away from said rotor means, and each of said cartridge cutting blade means having cartridge cutting blade indexing means for alignment with said cartridge cutting blade locating means, and each of said cartridge cutting blade means having:

a first surface adjacent said cartridge cutting blade mounting face of said cartridge body;

a second surface spaced from said first surface;

an inner surface extending between and intersecting each of said first surface and said second surface and in opposed relationship to said rotor means., and selectively positionable in preselected spaced relationships to said rotor means;

cartridge cutting blade hold-down bar means adjacent said second surface of each of said cartridge cutting blade means;

cartridge cutting blade retention means for engaging said cartridge cutting blade hold-down bar means and said cartridge body for clampingly mounting one of said cartridge cutting blade means on one of said cartridge bodies; and adjustment means for selectively moving said first cartridge means towards and away from said rotor means.

37. The arrangement defined in claim 36, and further comprising:

said rotor means rotatably mounted in said housing means for said rotation in said preselected direction about said rotor axis has an outer peripheral edge; and said rotor means comprising:

a plurality of lobes on said outer peripheral edge of said rotor means and said lobes extending axially a first preselected distance;

each of said lobes having:

a blade face extending a second preselected distance inwardly from said outer peripheral edge;

rotor cutting blade locating means on said blade face of each of said lobes;

rotor cutting blade means mounted on each of said blade faces of said rotor means for limited reciprocal movement towards and away from said outer peripheral edge and having rotor cutting blade indexing means for alignment with said rotor cutting blade locating means on said blade faces of said rotor means, and said rotor cutting blade means having:

a first surface adjacent said blade faces;

a second surface spaced from said first surface;

an outer surface extending between and intersecting each of said first and said second surfaces, and said outer surface extending a third preselected distance outwardly from said outer peripheral edge of said rotor means, and said rotor cutting blade means substantially rectangular in cross-section;

rotor cutting blade hold-down bar means adjacent said second surfaces of each of said rotor cutting blade means;

rotor cutting blade retention means for engaging said rotor cutting blade hold-down bar means and said lobes of said rotor means for clamping retention of said rotor blade means on said lobes of said rotor means whereby said rotor cutting blade means passes in material-severing relationship to said cartridge cutting blade means.

38. The arrangement defined in claim 37 and further comprising:

rotor cutting blade hold-down bar locating means on said rotor cutting blade hold-down bar and on said second surface of said rotor cutting blade means, and said rotor cutting blade hold-down bar locating means aligned with said rotor cutting blade locating means on said blade face of said lobes; and cartridge cutting blade hold-down bar locating means on said cartridge cutting blade hold-down bar and on said second surface of said cartridge cutting blade means, and said cartridge cutting blade hold-down bar locating means aligned with said cartridge cutting blade locating means on said cartridge cutting blade mounting face of each of said cartridge body means.

39. The arrangement defined in claim 37, wherein:

said rotor cutting blade retention means of said rotor cutting blade means further comprises:

screw means extending through said rotor cutting blade hold-down bar means of said rotor cutting blade means for threading engagement with said lobes;

said cartridge cutting blade retention means of each of said cartridge cutting blade means further comprises:

screw means extending through said cartridge cutting blade hold-down bar means of said cartridge cutting blade means for threading engagement with said cartridge body means.

40. The arrangement defined in claim 39, wherein:

said screw means of said rotor cutting blade retention means is free of engagement with said rotor cutting blade means, whereby said rotor cutting blade means is detachably clamped between said rotor cutting blade hold-down bar means and said lobes of said rotor means;

said screw means of said cartridge cutting blade retention means is free of engagement with said cartridge cutting blade means, whereby said cartridge cutting blade means is detachably clamped between said cartridge cutting blade hold-down bar means and said cartridge body.

41. The arrangement defined in claim 37, wherein:

said rotor cutting blade locating means of said rotor means further comprises:

walls in said blade face of said lobes defining locating button receiving cavities:

a plurality of locating buttons, one of said plurality of locating buttons positionable in each of said locating button receiving cavities, and each of said plurality of locating buttons having an outer face projecting a fourth preselected distance above said blade face of said lobes, and said outer faces of said plurality of locating buttons having a plurality of serrations therein.

42. The arrangement defined in claim 41, wherein:

said plurality of locating buttons of said rotor cutting blade locating means are in an axially extending, linear, spaced apart array on each of said blade faces of said lobes;

said plurality of locating buttons of said cartridge cutting blade locating means are in an axially extending linear spaced apart array on said cartridge cutting blade mounting face of said cartridge body.

43. The arrangement defined in claim 42, wherein:

said plurality of locating buttons of said rotor cutting blade locating means are sections of right circular cylinders;

said plurality of locating buttons of said cartridge cutting blade locating means are sections of right circular cylinders.

44. The arrangement defined in claim 43, wherein:

said rotor cutting blade indexing means of said rotor cutting blade means further comprises:

a plurality of serrations in said first surface of said rotor cutting blade means of said lobes for engagement with said serrations in said outer face of said plurality of locating buttons of said rotor cutting blade locating means;

said cartridge cutting blade indexing means of said cartridge cutting blade means further comprises:

a plurality of serrations in said cartridge cutting blade means for engagement with said serrations in said outer faces of said plurality of locating buttons in said cartridge cutting blade locating means.

45. The arrangement defined in claim 37, wherein:

said rotor cutting blade indexing means of said rotor cutting blade means further comprises:

a plurality of serrations in said first surface of said rotor cutting blade means of said lobes for engagement with said serrations in said outer face of said plurality of locating buttons of said rotor cutting blade locating means;

said cartridge cutting blade indexing means of said cartridge cutting blade means further comprises:

a plurality of serrations in said cartridge cutting blade means for engagement with said serrations in said outer faces of said plurality of locating buttons in said cartridge cutting blade locating means.

46. The arrangement defined in claim 37 and further comprising:

drive means for rotating said rotor means in said preselected direction about said rotor axis.

47. The arrangement defined in claim 46, wherein:

said drive means comprises an electric motor for rotating said rotor means in said preselected direction.

48. The arrangement defined in claim 37, wherein:

said adjustment means further comprises:

a plurality of set screws extending through said cartridge body means and engaging said housing means for providing limited linear reciprocating motion of each of said first cartridge means and said second cartridge means towards and away from said housing means.

49. The arrangement defined in claim 37, wherein:

each of said rotor cutting blade means and said cartridge cutting blade means are substantially similar; and each of said rotor cutting blade hold-down bar means and said cartridge cutting blade hold-down bar means are substantially similar.

* * * * *